United States Patent [19]

Cassia

[11] 4,214,676

[45] Jul. 29, 1980

[54] DISPENSER FOR LIQUID SOAP WITH TELESCOPING HOUSING MEMBERS AND CONTAINER THEREFOR

[75] Inventor: Antonio M. Cassia, Milan, Italy

[73] Assignee: Steiner Corporation, Salt Lake City, Utah

[21] Appl. No.: 903,867

[22] Filed: May 8, 1978

[30] Foreign Application Priority Data

Nov. 25, 1977 [IT] Italy ..... 51941 A/77

[51] Int. Cl.[2] ..... B67B 7/28; B67D 5/40

[52] U.S. Cl. ..... 222/83.5; 222/181; 222/207; 222/383

[58] Field of Search ..... 222/83.5, 86, 88, 181, 222/182, 183, 185, 207, 209, 212, 213, 214, 215, 320, 321, 325, 379, 380, 381, 383, 541, 523, 524; 417/480

[56] References Cited

U.S. PATENT DOCUMENTS

| | | | |
|---|---|---|---|
| 2,620,943 | 12/1952 | Critelli et al. | 222/383 X |
| 3,200,994 | 8/1965 | Levinson et al. | 222/181 X |
| 3,288,332 | 11/1966 | Etter et al. | 222/181 X |
| 3,434,629 | 3/1969 | Hodge et al. | 222/88 |
| 3,471,065 | 10/1969 | Malone | 222/321 |
| 3,726,442 | 4/1973 | Davidson et al. | 222/207 |
| 3,840,154 | 10/1974 | Speak | 222/181 |
| 4,018,363 | 4/1977 | Cassia | 222/207 X |

FOREIGN PATENT DOCUMENTS 850624 10/1961 France .

*Primary Examiner*—David A. Scherbel
*Assistant Examiner*—Fred A. Silverberg
*Attorney, Agent, or Firm*—Vogel, Dithmar, Stotland, Stratman & Levy

[57] ABSTRACT

A dispenser for liquid soap including two telescoping housing members generally cylindrical in shape and having the longitudinal axes thereof inclined upwardly, the inner housing member being mountable on a wall and the outer housing member having a broad contact area accessible to a user, a support extending upwardly and forwardly from the inner housing member and telescopically receiving a guide on the outer housing member with a spring therebetween, a discharge member removably mounted on the inner housing member and having a soap outlet in registration with an opening with the outer housing member and having structure for removably attaching a liquid soap container thereto, a pump on the discharge member for pumping charges of liquid soap from the liquid soap container to the soap outlet, and an actuating member on the outer housing operating the pump upon shifting of the housing members from the rest positions thereof to the actuating positions thereof; also disclosed is a novel container for liquid soap for use in the dispenser.

22 Claims, 7 Drawing Figures

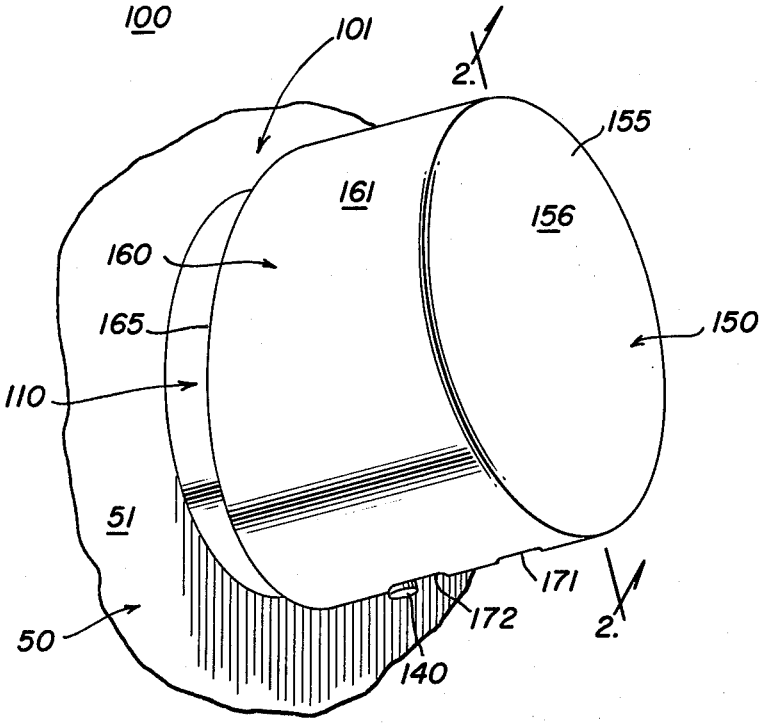
FIG. 1
FIG. 3
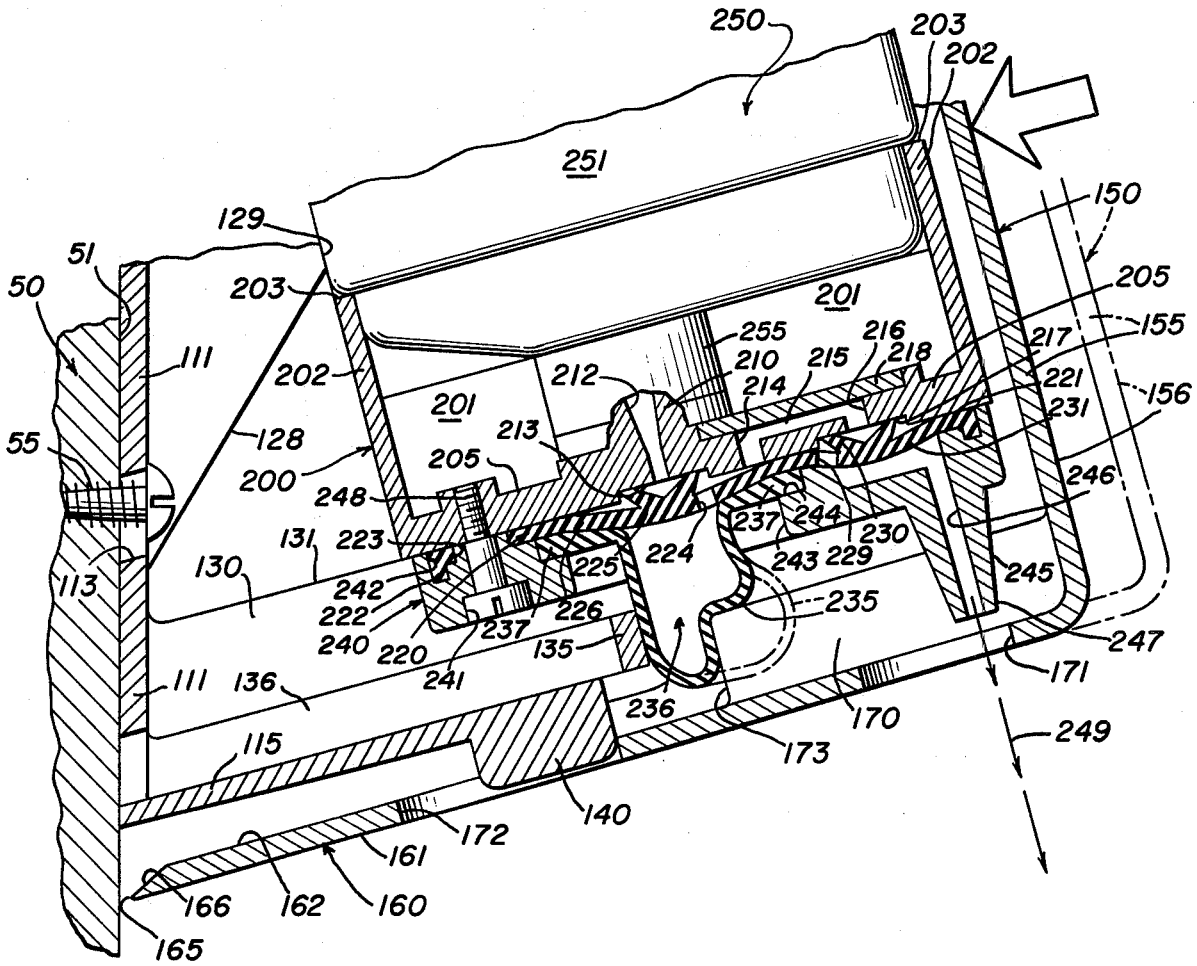

DISPENSER FOR LIQUID SOAP WITH TELESCOPING HOUSING MEMBERS AND CONTAINER THEREFOR

BACKGROUND OF THE INVENTION

The present invention relates generally to improvements in dispensers for liquid soap, and specifically to the provision of a novel dispenser housing and a novel soap container for use therein.

The present invention is an improvement upon the applicant's prior soap dispenser as disclosed in U.S. Pat. No. 4,018,363 granted Apr. 19, 1977. In the prior soap dispenser, a shiftable lever was disposed below the dispenser housing and actuated the pump in the dispenser housing when the lever was pulled forwardly. It has been found that pulling the lever forwardly is not always convenient, for often it is more convenient for a user to put the palm of his hand on a member or even his forearm or elbow. Therefor the present invention provides a large contact area for the user to actuate the soap pump, the contact area being satisfactorily operated by the users fingers, palm, forearm, elbow or any other portion of the body.

Other patents showing various actuators for liquid soap pumps are U.S. Pat. No. 3,726,442 granted Apr. 10, 1973 to Davidson et al. and French Patent No. 1,278,449 granted Oct. 30, 1961. Although the actuators for the pumps of these dispensers might be actuated by parts of the body other than the finger, the trigger areas are very small and are not readily actuated by a palm, forearm or elbow of the user..

The above named patents also show various containers for liquid soap useful in the dispensers, but none would be useful in the dispenser of the present invention.

SUMMARY OF THE INVENTION

The present invention provides a dispenser for liquid soap that can be readily actuated by the fingers, palm, forearm or elbow of the user, and also provides a novel container for liquid soap particularly adapted for use with the dispenser of the present invention.

This is accomplished in the present invention, and it is an object of the present invention to accomplish these desired results, by providing a dispenser for liquid soap having an enclosed housing including two telescoping housing members shiftable with respect to each other between a rest position and an actuating position, one of the housing members being mountable on a wall to mount the dispenser thereon, resilient means urging the housing members to the rest positions thereof, a discharge member mounted in the housing and having a soap outlet in registration with an opening in the housing for dispensing liquid soap therethrough, the discharge member including structure for removably attaching a liquid soap container thereto with the attached liquid soap container communicating with the soap outlet, pump means mounted in the housing for pumping charges of liquid soap from a liquid soap container on the discharge member and out through said soap outlet, and an actuating member on one of the housing members engaging the pump means to actuate the same upon the shifting of the housing members from the rest positions thereof to the actuating positions thereof, the other housing member presenting a large area for contact by a user for shifting the housing members from the rest positions thereof to the actuating positions thereof.

Another object of the invention is to provide a dispenser for liquid soap of the type set forth wherein a telescoping support and guide are provided between the housing members, the support and guide being inclined upwardly so as to present the actuating surface on the other housing member at an inclined angle with respect to the vertical.

Yet another object of the invention is to provide a dispenser for liquid soap of the type set forth incorporating therein an improved soap pump which has a resilient pump body squeezed between an abutment on one of the housing members and a contact surface on the other housing member for operating the pump.

A further object of the invention is to provide an improved soap container for use with a dispenser for liquid soap of the type set forth.

Further features of the invention pertain to the particular arrangement of the parts of the dispenser and container, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 1 is a perspective view of a dispenser for liquid soap made in accordance with and embodying the principles of the present invention;

FIG. 3 is a fragmentary cross sectional view similar to FIG. 2 and illustrating only the lower portion of the dispenser with the parts shown in solid lines in the dispensing position thereof;

DESCRIPTION OF THE PREFERRED EMBODIMENT

Figures 2, 7:
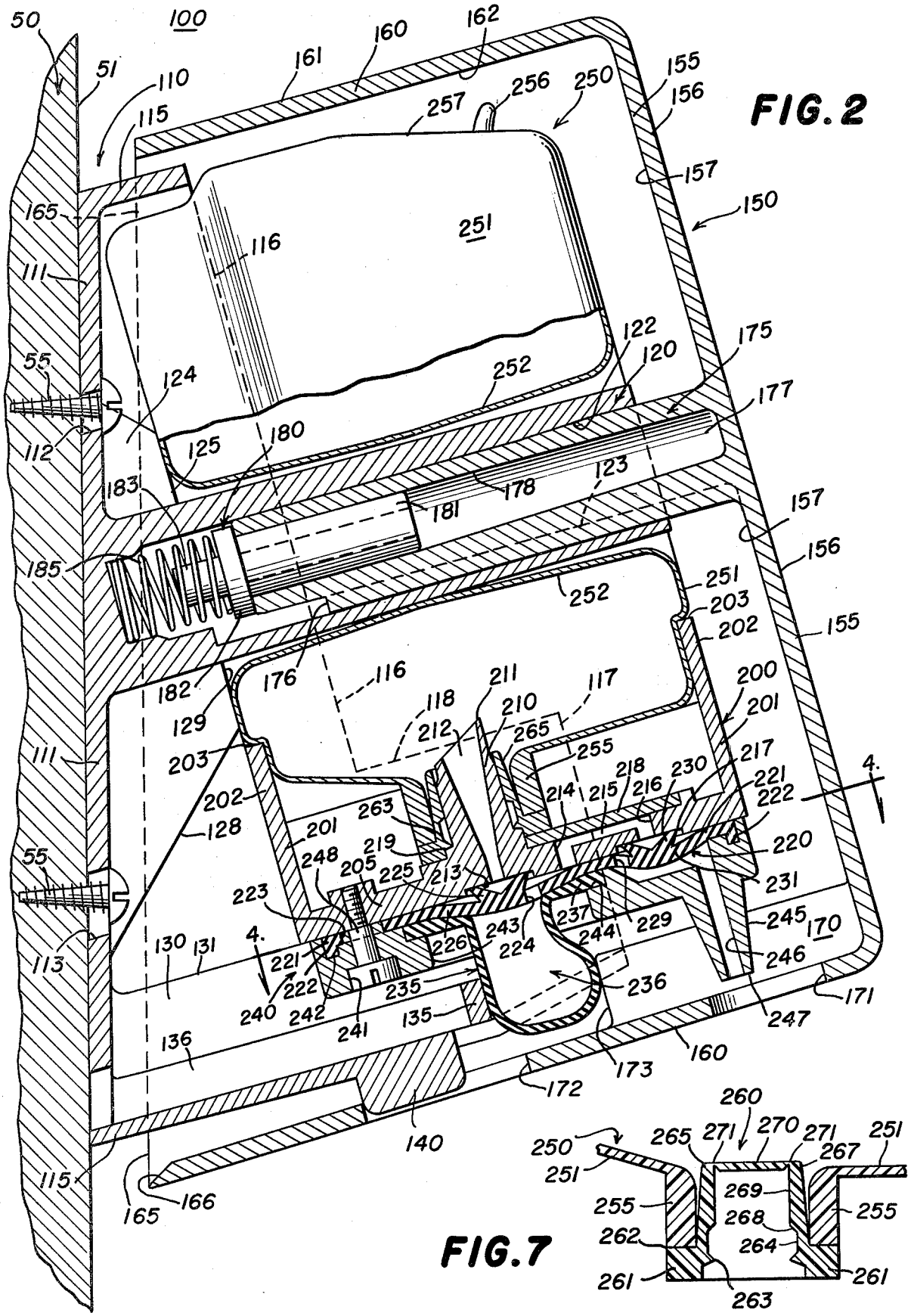
FIG. 2 is an enlarged view in vertical section through the dispenser of FIG. 1 along the line 2—2 thereof.
FIG. 7 is a fragmentary view in vertical section through the neck of a liquid soap container of the present invention showing the condition thereof prior to placement in the dispenser of FIGS. 1–6.

Referring to FIGS. 1 and 2 of the drawings, there is shown a dispenser 100 for liquid soap, the dispenser 100 being made in accordance with and embodying the principles of the present invention. An enclosed housing 101 is formed by two telescoping housing members 110 and 150 and is mounted upon a support wall 50 and resting against the outer surface 51 thereof by means of two screws 55. Disposed in the housing 101 is a liquid soap container or cartridge 250 which through the action of a discharge member 200 supplies soap through a spout 245 to a user upon the user pushing the outer housing 250 to the left as viewed in FIGS. 1 and 2.

Figure 6:
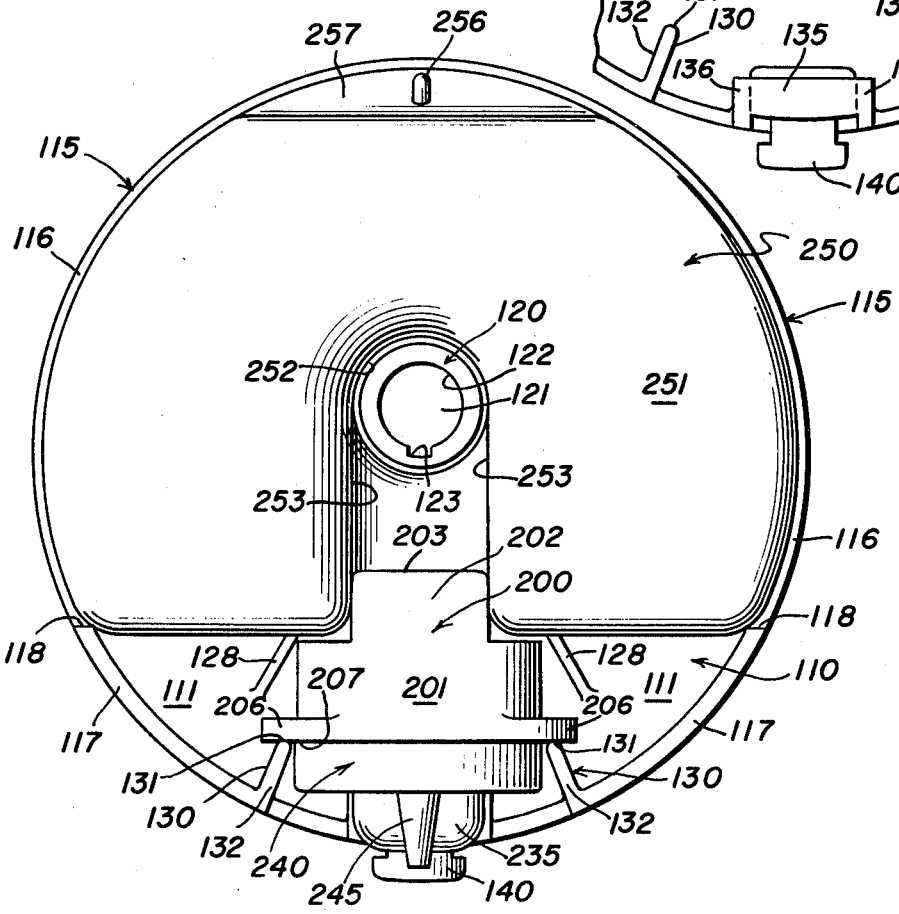
FIG. 6 is a view of the dispenser of FIGS. 1–3 with the outer housing member thereof removed to illustrate the mounting of the liquid soap container and the liquid soap pump on the inner housing member.

The inner housing member 110 serves as a support base to mount the dispenser 100 on the wall 50, and also supports all of the other parts of the dispenser 100 thereon. Housing member 110 includes a rear wall 111 having a circular mounting opening 112 toward the top thereof and an elongated mounting opening 113 toward the bottom thereof receiving the mounting screws 55 therethrough for mounting upon the adjacent support wall 50. Referring also to FIG. 6, it will be seen that the inner housing member 110 is generally circular in form and has a cylindrical wall 115 extending outwardly therefrom with the axis thereof inclined upwardly at an angle of about 35° with respect to the horizontal and the plane of the rear wall 111. The cylindrical wall 115 in the upper portion thereof terminates in a rearwardly disposed part-circular edge 116 (see FIG. 2) that is in a plane essentially normal to the axis of the cylindrical wall 115 and a forwardly disposed part-circular edge 117 that also lies in a plane essentially normal to the longitudinal axis of the cylindrical wall 115 and parallel to the plane of the rearwardly disposed edge 116.

Extending forwardly from the rear wall 111 of the inner housing member 110 and disposed essentially centrally thereof in a lateral direction but displaced upwardly in a vertical direction is a cylindrical support 120, the longitudinal axis of the cylindrical support 120 being parallel to the longitudinal axis of the cylindrical wall 115 and therefor being disposed at an angle of about 35° with respect to the horizontal and the plane of the rear wall 111. The support 120 has an inner opening 121 therein defined by an inner surface 122, a keyway 123 being provided in the lower portion thereof (see FIGS. 5 and 6 also). Radiating outwardly from the cylindrical support 120 are six reinforcing ribs, two upper and shorter reinforcing ribs 124 being provided having forward surfaces 125, two laterally extending reinforcing ribs 126 being provided having forward surfaces 127 and two longer and downwardly radiating reinforcing ribs 128 being provided having forward surfaces 129. The forward surfaces 125 and 127 and 129 all lie in a common plane that is parallel to the planes of the surfaces 116 and 117 and which forward surfaces cooperate to support the rear of the soap container 250 as will be described more fully hereinafter.

Figure 5:
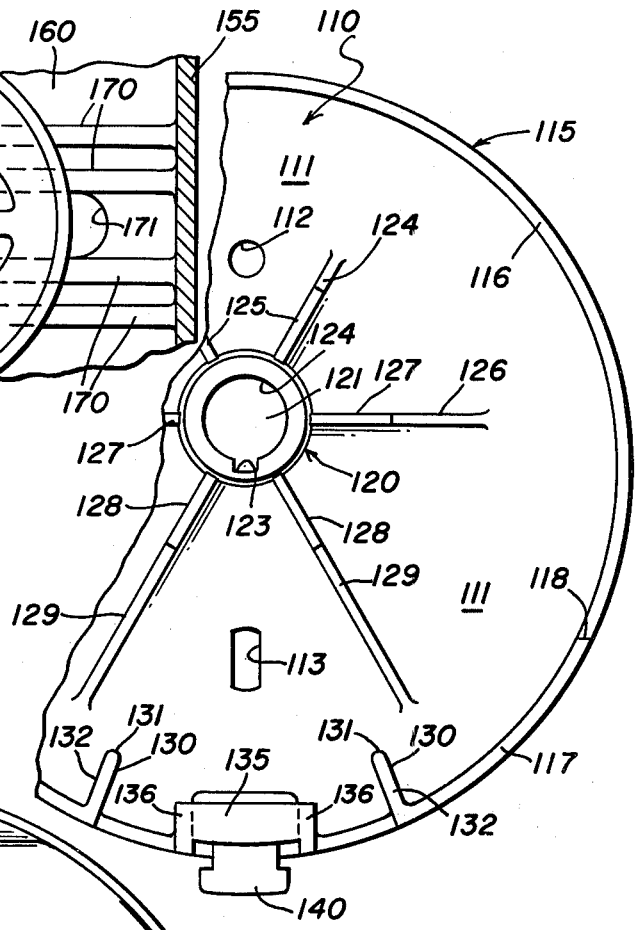
FIG. 5 is a fragmentary front elevational view of the inner housing member forming a part of the dispenser of FIGS. 1–3.

Disposed in the lower portion of the inner housing member 110 and extending radially inwardly from the cylindrical wall 115 are two support ribs 130 having support surfaces 131 thereon, the outer ends 132 of the support ribs 130 terminating in the same plane as the forward edges 117 of the cylindrical wall 115. Also disposed in the lower portion of the housing member 110 is an abutment 135 (see FIGS. 2 and 5 particularly) which is supported by reinforcing ribs 136 that extend forwardly from the rear wall 111. Finally, a stop 140 is provided on the cylindrical wall 115 extending downwardly therefrom as is best illustrated in FIGS. 2, 5 and 6 of the drawings.

The outer housing member 150 fits over and telescopically receives the inner housing member 110 and includes a front wall 155 having an outer surface 156 and an inner surface 157, the outer surface 156 being essentially flat and circular in shape (see FIG. 1 also) and lying in a plane that is inclined at an angle of about 35° with respect to the vertical and the plane of the rear wall 111. The surface 156 is contacted by the user when it is desired to dispense a charge of soap from the dispenser 100. Extending rearwardly from the front wall 155 is a cylindrical side wall 160 having an outer surface 161 and an inner surface 162, the side wall 160 terminating in a rear edge 165 that is normally spaced from the support surface 51 when the parts are in the rest position of FIG. 2, and lies in a plane essentially parallel to the rear wall 111 of the inner housing member 110, whereby the plane defined by the rear edge 165 is disposed at an acute angle of about 35° with respect to the front surface 156. The lower portion of the side wall 160 is bevelled as at 166 to assist in assembling the outer housing member 150 on the inner housing member 151 and over the stop 140, all as will be explained more fully hereinafter.

Disposed within the side wall 160 and extending rearwardly from the front wall 155 are four actuating ribs 170 (see FIG. 4 also) which have contact surfaces 173 that operate a pump system to be described more fully hereinafter. Disposed between the inner two ribs 170 is an elongated opening 171 that is in alignment with the discharge spout 245 in all positions of the outer housing member 150, i.e., both in the rest position of FIG. 2 and in the fully actuated position of FIG. 3. Also formed in the lower portion of the side wall 160 is an elongated opening 172 that receives the stop 140 therein, the longitudinal extent of the opening 172 being sufficiently great so as to provide a positive stop or abutment for the stop 140 in the rest position illustrated in FIG. 2 and to provide a positive stop or abutment for the stop member 140 in the fully actuated position illustrated in FIG. 3.

Formed integral with the front wall 155 and extending rearwardly and downwardly therefrom to the left as viewed in FIG. 2 is a cylindrical guide 175 that is received within the opening 121 in the cylindrical support 120. The guide 175 has a key 176 extending downwardly therefrom and engaging in the keyway 123 so as to limit the rotative movement between the housing members 110 and 150, while accommodating the sliding movement thereof in a direction parallel to the axes of the cylindrical support 120 and the guide 175. The guide 175 has an opening 177 therein defined by an inner wall 178 and receiving a spring support 180, and specifically a cylindrical body 181 thereon. Extending radially outwardly from the body 181 is a flange 182 from which extends to the left a projection 183. A spring 185 under compression is disposed in the lefthand end of the inner opening 121 in the cylindrical support 120 and acts against the spring support 180, thereby to urge the outer housing member 150 to the right and to the rest position thereof illustrated in FIG. 2 wherein the stop 140 engages the lefthand end of the opening 172. The outer housing member 150 is shiftable between the rest position illustrated in FIG. 2 and the fully actuated position illustrated in FIG. 3 and against the action of the spring 185, the spring 185 serving thereafter to return the outer housing member 150 to the rest position thereof illustrated in FIG. 2.

In order to extract a charge of soap from the soap container 250, a discharge member 200 has been provided having an oval side wall 201 with upstanding part-circular ends 202 disposed at the front and back thereof, the ends 202 having upper edges 203 that assist in supporting the soap container 250. The side wall 201 is closed in the lower portion thereof by a bottom wall 205 which carries laterally extending support flanges 206 on either side thereof (see FIG. 6 also) having support surfaces 207 on the lower portions thereof that rest upon and are supported by the support surfaces 131 on the support ribs 130. Since the support surfaces 131 are inclined downwardly and to the rear, they serve to support the discharge member 200 without the requirement for additional attaching structure, the discharge member 200 therefore being readily removably mounted upon and supported by the inner housing member 110.

Disposed in and formed integral with the bottom wall 205 is an upwardly extending piercing member 210 having a bevelled cutting edge 211 at the upper end thereof and having a suction conduit 212 extending downwardly therethrough. Formed in the lower surface of the bottom wall 205 is a first valve seat 213, and extending through the bottom wall 205 are spaced-apart openings 214 and 216 with a supply conduit 215 interconnecting the same and defined in part by a plate 218 fixedly secured to the upper surface of the bottom wall 205. Surrounding the opening 216 and disposed in the lower surface of the bottom wall 205 is a second valve seat 217. There further is provided around the piercing member 210 a laterally extending shoulder 219 which serves to form a seal with the container 250 as will be explained more fully hereinafter.

Figure 4:
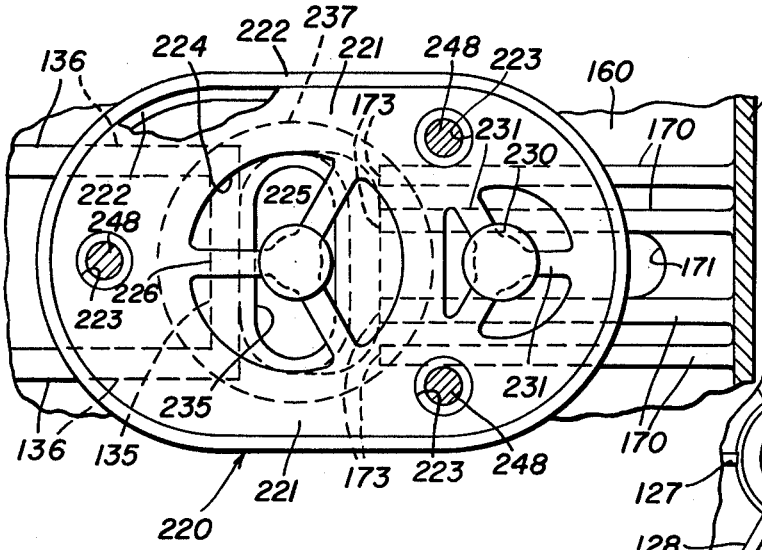
FIG. 4 is a fragmentary view in section along the line 4—4 of FIG. 2.

Secured to the undersurface of the bottom wall 205 by a pump support 240 is a valve diaphragm 220 (see FIG. 4 also). The valve diaphragm 220 has a generally oval-shaped body 221 around which extends a sealing flange 222 that is used to seal the outer edge of the valve diaphragm 220 to the pump support 240. Extending through the body 221 are three bolt receiving openings 223, and also disposed therein are two valve members receiving openings 224 and 229. Disposed in the center of the opening 224 is a valve member 225 secured to the body 221 by three radially extending webs 226. The valve member 225 registers with and is disposed in the valve seat 213 so as selectively to close and to open the suction conduit 212 in the piercing member 210. Disposed in the opening 229 is a second valve member 230 held in place by three radially extending webs 231 and being disposed in the valve seat 217 selectively to open and to close the supply conduit 215.

Positioned below the valve diaphragm 220 and in general registration with the valve seat 213 is a pump body 235 formed of resilient plastic and defining a soap-receiving chamber 236 and having an outwardly radially extending mounting flange 237 surrounding the upper open end thereof.

The valve diaphragm 220 and the pump body 235 are held in operative relationship with the discharge member 200 by the pump support 240, the pump support 240 being generally oval in shape and corresponding in shape generally to the bottom wall 205 on the discharge member 200. Extending through the pump support 240 are three bolt-receiving openings 241 that are in registry with the opening 223 in the valve diaphragm 220 and with openings in the bottom wall 205 to receive three bolts 248 therethrough to hold the parts in the assembled position. The pump support 240 further has an oval recess 242 extending therearound that receives the flange 222 on the valve diaphragm 220 so as to form a hermetic seal at that point between the bottom wall 205 and the valve diaphragm 220 and the pump support 240. A large opening 243 is provided in the pump support 240 and in registry with the valve seat 213 and the opening 214. Extending around the opening 243 is a shoulder 244 that receives thereon the mounting flange 237 of the pump body 235 so as to clamp and mount the pump body 235 in the operative position while making a hermetic seal between the pump body flange 237 and the adjacent portions of the valve diaphragm 220 and the pump support 240. It will be seen from FIG. 2 that the pump body 235 extends downwardly through the opening 243 and in front of the abutment 135 and behind the actuating ribs 170 and specifically the contact surfaces 173 thereon, whereby movement of the outer housing member 150 from the rest position illustrated in FIG. 2 to the actuated position illustrated in FIG. 3 compresses the pump body 235 therebetween and materially decreases the volume of the chamber 236 defined by the pump body 235. The spout 245 is integral with the pump support 240 and extends downwardly therefrom and in registry with the opening 171 in the outer housing member 150. Formed in the spout 245 is an opening 246 that communicates with the opening 216 and the discharge conduit 215 when the valve 230 is in the open position thereof. The lower end 247 of the spout 245 terminates a short distance above the inner surface of the side wall 160 of the outer housing member 150 but in registry with the opening 171 therein at all times. When the dispenser is actuated, the spout 245 serves to eject a charge of soap in a stream 249 (see FIG. 3) through the opening 171 and into position for use by a user.

Soap to be dispensed by the dispenser 100 is provided in the liquid soap container or cartridge 250, the details of construction of which are best illustrated in FIGS. 2, 3 and 6 of the drawings. The container 250 includes a relatively large bladder 251 formed of a flexible plastic and essentially filling the space between the inner and outer housing members 110 and 150 when in the fully actuated positions illustrated in FIG. 3. To this end there is provided an inner wall 252 that provides a cylindrical opening to receive the cylindrical support 120 therethrough and also recesses 253 in the front and rear (see FIG. 6) that receive therein the ends 202 on the discharge member 200. Secured to the lower portion of the container 250 is a relatively rigid neck 255 formed of plastic which receives a plug 260, also formed of plastic. The other end of the bladder 251 has an extension 256 disposed on a sloping surface 257, the extension 256 being readily punctured or removed so as to provide an air opening to the interior of the bladder 251 to facilitate withdrawal of the liquid soap therefrom.

The plug 260 is best illustrated in FIGS. 2 and 7 of the drawings and includes an annular body 261 which is shaped and arranged to close the outer end of the neck 255, and is preferably secured thereto by an ultrasonic weld as at 262. Extending inwardly from the annular body 261 is an inner projection 263 that has a sharp edge defining an opening that just receives the piercing member 211 thereinto and forms a seal therewith. Disposed above the projection 263 is an inner cylindrical surface 264 from which extends upwardly a cylindrical spout or sleeve 265. The spout 265 has a tapered wall 267 externally thereof and a shoulder 268 and generally cylindrical sealing surface 269 internally thereof. The upper end of the spout 265 as viewed in FIG. 7 is sealed by an integral closure wall 270 that is secured to the spout 265 by a thinner portion 271 extending therearound. The closure wall 270 is spaced from the discharge end of the plug 260 a distance equal at least to the inner diameter of the plug 260 to prevent inadvertent puncture of the closure wall 270.

The plug 260 serves to close the container neck 255 and provides a hermetic seal therefor. When the container 250 is mounted upon the discharge member 200, the piercing member 210 thereof is inserted into the plug 260 and through the spout 265 until the cutting edge 211 engages the closure wall 270. By the provision of the thin portion 271 around the closure wall 270, the cutting edge 211 of the piercing member 210 is able readily to push the closure wall 270 out of position and to break the seal therewith thus to mount the discharge member 200 on the container 250. A seal is made between the piercing member 210 and the plug 260, the inner projection 263 forming a sealing contact with the outer surface of the piercing member 210 and resting upon the shoulder 219 thereof, and the sealing surface 269 also forming a sealing contact with the outer surface of the piercing member 210.

A cycle of use and operation of the dispenser 100 will now be described in detail. Assuming that the supply of liquid soap in the container 250 has been exhausted, it is now necessary to remove the empty container 250 and replace it with a filled container 250. The first step is to remove the outer housing member 150. This is accomplished by deforming the side wall 160 downwardly and the stop 140 upwardly so as to clear the stop 140 from the opening 172, this being possible by forming the housing members 110 and 150 from a generally resilient plastic, a preferred resilient plastic being an acrylonitrile-butadiene-styrene copolymer (ABS plastic). Having cleared the stop 140 from the opening 172 in the outer housing member 150, the outer housing member 150 can be withdrawn upwardly and to the right as viewed in FIG. 2 until guide 155 is disengaged from the cylindrical support 120. Next the discharge member 200 and all of attached parts, including the now empty soap container 250, can be removed from the inner housing member 110 by simply sliding the parts forwardly and upwardly to the right as viewed in FIG. 2 until the container 250 clears the cylindrical support 120. The only thing then remaining is the inner housing member 110 which has no parts now mounted thereon, and therefore appears much as it does in FIG. 5 of the drawings.

The empty container 250 is then inverted and removed from the discharge member 200, i.e., more specifically, the plug 260 is removed from the piercing member 210. A filled soap container 250 is then provided and positioned with the neck 255 disposed upwardly. The discharge member 200 is inverted and the piercing member 210 pushed downwardly into the plug 260 and into contact with the closure wall 270 to rupture the thin portion 271. The discharge member 200 with the now attached soap container 250 is then inverted, it being noted that the suction conduit 212 is closed by the valve member 225 so as to prevent discharge of soap from the soap container 250. The support flanges 206 are placed in alignment with the upper edges of the support ribs 130 and the annular wall 252 of the container 250 is placed in alignment with the cylindrical support 120. The parts are then slid downwardly and to the left as viewed in FIG. 2 until the bladder 251 comes to rest against the forward surfaces 125 and 127 and 129, and until the discharge member 200, and specifically the support flanges 206 thereof, are firmly seated upon the support ribs 130 and until the pump body 235 is resting against the abutment 135. It will be appreciated that the parts will tend to remain in this position since gravity will urge the parts downwardly and to the left as viewed in FIG. 2. Next the extension 256 is punctured or removed so as to provide an air inlet into the interior of the bladder 251.

The outer housing member 150 is then replaced by extending the guide 175 into the cylindrical support 130, care being taken that the key 176 is disposed in the keyway 123. The bevelled surface 166 tends to cam outwardly to the bottom portion of the side wall 161 and across the stop 140 until the stop 140 drops into the opening 172. The parts are now in position to resume dispensing of liquid soap from the soap container 250 and outwardly from the dispenser 100.

To dispense soap from the dispenser 100, the user contacts the front wall 155 of the outer housing member 150. In a constructional example of the dispenser 100, the front wall 155 has a diameter of 5½ inches, whereby to provide a substantial target for contact with the fingers, palm, hand, forearm or elbow of the user. The user pushes against the wall 155 in the direction of the large arrow in FIG. 3 to shift the outer housing member 150 from the rest position illustrated by dashed lines in FIG. 3 (and by solid lines in FIG. 2) to the fully actuated position illustrated by solid lines in FIG. 3. Such movement of the outer housing member 150 to the left in FIG. 3 is accommodated by compression of the spring 185.

Movement of the outer housing member 150 to the left serves to compress the pump body 255, and since there is no liquid soap therein as yet, no soap will be expelled from the spout 245. Release of the outer housing member 150 will permit the spring 185 to push the parts to the rest position (the solid line position of FIG. 2 and the dashed line position of FIG. 3). The pump body expands so as to reduce the pressure therein and this causes the valve member 255 to pull away from the valve seat 213 and to permit a charge of soap to pass through the suction conduit 212 and through the opening 224 in the valve diaphragm and into the chamber 236 within the pump body 235. The next time the user pushes the outer housing member 150 from the rest position (dashed lines) to the fully actuated position (solid lines) in FIG. 3, the contact surfaces 173 on the actuating ribs 170 will compress the pump body 235 to the position illustrated in solid lines in FIG. 3. This causes liquid soap to be expelled through the openings 224, through the supply conduit 215 and past the valve 230 which is opened by the pressure thus produced, and through the openings 229 and 246 and out from the spout 245 as a stream 249.

When the user this time releases the outer housing member 150 to permit it to be moved by the spring 185 to the rest position, the pump body 235 again expands to provide an area of reduced pressure therein which now opens the valve 225 and draws another charge of liquid soap into the chamber 236. This action also closes the valve 230 since there is an area of reduced pressure now in the supply conduit 215 so that the atmospheric pressure tends to push the valve member 230 to the closed position thereof. When the user now again pushes the outer housing member 150 to the actuating position, the pressure will be increased in the pump body 235, thus to close the valve 225 and open the valve 230 and discharge a stream of liquid soap from the spout 245.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A dispenser for liquid soap comprising an enclosed housing including two telescoping housing members shiftable with respect to each other between a rest position and an actuating position, one of said housing members being mountable on a wall to mount the dispenser on the wall, resilient means urging said housing members to the rest positions thereof, a discharge member mounted in said housing and having a soap outlet in registration with an opening in said housing to dispense liquid soap therethrough, said discharge member including structure for removably attaching a liquid soap container thereto with the attached liquid soap container communicating with said soap outlet, said housing members being dimensioned and arranged for cooperation completely to enclose the liquid soap container when it is attached to said discharge member, pump means mounted in said housing for pumping charges of liquid soap from a liquid soap container on said discharge member and out through said soap outlet, and an actuating member on one of said housing members engaging said pump means to actuate the same upon the shifting of said housing members from the rest positions thereof to the actuating positions thereof, the housing member other than said wall-mountable housing member presenting a large area for contact by a user for shifting said housing members from the rest positions thereof to the actuating positions thereof.

2. The dispenser for liquid soap set forth in claim 1, wherein said resilient means is a compression spring acting between said telescoping housing members.

3. The dispenser for liquid soap set forth in claim 1, wherein said one housing member is the inner housing member mountable on a wall to mount the dispenser thereon.

4. The dispenser for liquid soap set forth in claim 1, wherein said discharge member is readily removably mounted upon said one housing member.

5. The dispenser for liquid soap set forth in claim 1, wherein said discharge member includes supports for an associated liquid soap container.

6. The dispenser for liquid soap set forth in claim 1, wherein said discharge member includes a piercing member extending upwardly therefrom to pierce a sealed liquid soap container to be mounted thereon.

7. The dispenser for liquid soap set forth in claim 1, wherein said other housing member is the outer one of said telescoping housing members.

8. The dispenser for liquid soap set forth in claim 1, wherein said actuating member is integral with said other housing member.

9. A dispenser for liquid soap comprising an enclosed housing including two telescoping housing members shiftable with respect to each other between a rest position and an actuating position, one of said housing members being mountable on a wall to mount the dispenser on the wall, a support extending upwardly from said one housing member and telescopically receiving and guiding a guide on the other of said housing members, resilient means acting between said support and said guide urging said housing members to the rest positions thereof, a discharge member mounted in said housing and having a soap outlet in registration with an opening in said housing to dispense liquid soap therethrough, said discharge member including structure for removably attaching a liquid soap container thereto with the attached liquid soap container communicating with said soap outlet, said housing members being dimensioned and arranged for cooperation completely to enclose the liquid soap container when it is attached to said discharge member, pump means mounted in said housing for pumping charges of liquid soap from a liquid soap container on said discharge member and out through said soap outlet, and an actuating member on one of said housing members engaging said pump means to actuate the same upon the shifting of said housing members from the rest positions thereof to the actuating positions thereof, said other housing members presenting a large area for contact by a user for shifting said housing members from the rest positions thereof to the actuating positions thereof.

10. The dispenser for liquid soap set forth in claim 9, wherein said resilient means is a spring acting between said support and said guide.

11. The dispenser for liquid soap set forth in claim 9, wherein a stop is provided on one of said housing members and extends through a slot in the other of said housing members and engaging the ends of said slot to establish the rest position and the actuating position of said housing members.

12. The dispenser for liquid soap set forth in claim 9, wherein a key and a cooperating keyway are provided on said support and said guide to restrict rotation between said telescoping housing members.

13. The dispenser for liquid soap set forth in claim 9, wherein said support and said guide are located centrally of said housing members and extend through a passage formed by the associated liquid soap container.

14. The dispenser for liquid soap set forth in claim 9, wherein housing members are essentially cylindrical in shape.

15. The dispenser for liquid soap set forth in claim 9, wherein the longitudinal axis of said support and said guide are inclined at an angle of about 35° to the horizontal.

16. The dispenser for liquid soap set forth in claim 9, wherein said contact area is circular in shape and is disposed upon the outer end of said other housing member and is disposed at an angle of about 35° to the vertical.

17. A dispenser for liquid soap comprising an enclosed housing including two telescoping housing members shiftable with respect to each other between a rest position and an actuating position, one of said housing members being mountable on a wall to mount the dispenser on the wall, resilient means urging said housing members to the rest positions thereof, a discharge member mounted in said housing and having a soap outlet in registration with an opening in said housing to dispense liquid soap therethrough, said discharge member including structure for removably attaching a liquid soap container thereto with the attached liquid soap container communicating with said soap outlet, a resilient pump body mounted on said discharge member between the exit from an associated liquid soap container on said discharge member and said soap outlet for pumping charges of liquid soap from the interior of the liquid soap container to said soap outlet, an abutment member on one of said housing members and an actuating member on the other of said housing members engaging said pump body disposed therebetween to compress the pump body upon the shifting of said housing members from the rest positions thereof to the actuating positions thereof, a first normally closed valve disposed between the exit from the associated liquid soap container and said pump body and a second normally closed valve disposed between said pump body and said soap outlet, compression of said pump body forcing liquid soap therein therefrom and past said second valve and out of said soap outlet and release of said pump body causing said pump body to resume its normal shape and to provide an area of reduced pressure therein opening said first valve and drawing liquid soap from the associated container into said pump body, said other housing member presenting a large area for contact by a user for shifting said housing members from the rest positions thereof to the actuating positions thereof.

18. The dispenser for liquid soap set forth in claim 17, wherein said pump body is disposed below said discharge member so that gravity aids in feeding liquid soap from the associated container into said pump body.

19. A liquid soap container for use with a dispenser having telescoping cylindrical housing members connected by a telescoping support and guide disposed essentially centrally therethrough and carrying in the bottom of the housing a discharge member with a piercing member extending upwardly therefrom and having a passage therein communicating with a soap outlet in registration with an opening in the housing at the bottom thereof, said container comprising a flexible bladder shaped to be removably confined entirely within the housing members and essentially to fill the outer telescoping housing member and said container forming a passage receiving the telescoping support and guide therethrough, and a cylindrical neck sealed to said bladder and having a sealing member therein sealing said neck and adapted to be disposed outwardly and into piercing relationship with the associated piercing member in use, said neck being dimensioned for encircling the associated piercing member while receiving the piercing member therein for piercing said sealing member and to form a seal between said container and the associated discharge member.

20. The liquid soap container set forth in claim 19, wherein said bladder is formed of a soft deformable plastic.

21. The liquid soap container set forth in claim 19, wherein said sealing member is spaced from the discharge end of said neck a distance equal approximately to the inner diameter of said neck.

22. The liquid soap container set forth in claim 19, and further comprising a readily puncturable extension integral with said bladder at the end thereof disposed away from said neck and operative upon being punctured to provide an inlet for air into the interior of said bladder during withdrawal of liquid soap therefrom.

* * * * *